United States Patent [19]

Muhl

[11] Patent Number: 4,493,973

[45] Date of Patent: Jan. 15, 1985

[54] FLOW CONTROLLED ELECTRODE TYPE LIQUID HEATER

[76] Inventor: Andrew H. Muhl, 2109 Huldy, Houston, Tex. 77019

[21] Appl. No.: 547,022

[22] Filed: Oct. 31, 1983

[51] Int. Cl.[3] ..... H05B 3/60; F22B 1/30

[52] U.S. Cl. ..... 219/286; 219/289; 219/293; 219/295; 338/81; 338/83

[58] Field of Search ..... 219/284–295, 219/271–276; 338/80–86

[56] References Cited

U.S. PATENT DOCUMENTS

| | | | |
|---|---|---|---|
| 2,090,282 | 8/1937 | Bock | 219/286 |
| 3,144,546 | 8/1964 | Foley et al. | 219/289 |
| 3,809,857 | 5/1974 | Muhl | 219/286 |
| 4,326,120 | 5/1982 | Muhl | 219/286 |

*Primary Examiner*—A. Bartis

*Attorney, Agent, or Firm*—Hubbard, Thurman, Turner & Tucker

[57] ABSTRACT

An electrode type liquid heater includes a tank having an inlet and an outlet disposed so that in normal operation of the heater the tank is partially filled with electrically conductive liquid below an electrically nonconductive air space. A plurality of electrodes, at least one of which is carried by a movable heating assembly, are immersed in the liquid and a voltage is applied thereacross for heating the liquid. The movable heating assembly is urged by a counterweight to a normal position wherein the at least one electrode carried by the assembly located in the air space. The flow of water to be heated discharges from the inlet onto a surface on the heating assembly opposite the counterweight to move the at least one electrode to a position immersed in the liquid. Preferably the surface is shaped to form a cup which may capture a sufficient portion of the inlet liquid so that the weight of the captured liquid provides an immersing force to overcome the counterweight and move the at least one electrode to an immersed position. The cup is provided with a drain so that it may be emptied when the discharge of inlet liquid into the heater ceases. Additionally, the immersing force may be developed by the impact of moving inlet liquid discharged from the inlet onto the surface. In the absence of the immersing force after the cup has drained and the impact stopped, the counterweight rapidly returns the heating assembly to its normal position with the at least one electrode carried thereby completely removed from the tank liquid so that the heating stops.

11 Claims, 4 Drawing Figures

FLOW CONTROLLED ELECTRODE TYPE LIQUID HEATER

BACKGROUND OF THE INVENTION

This invention relates generally to liquid heaters of the electrode type in which an electrically conductive liquid is heated by an electrical current passing between immersed electrodes and more particularly concerns an electrode type liquid heater in which the heating of the liquid is controlled by immersing the electrodes in the liquid only when additional liquid is flowing into the heater.

Electrode type liquid heaters are capable of rapidly heating small quantities of liquids such as water for use in homes. Their rapid heating ability eliminates the requirement of storing large quantities of heated water for use upon demand such as is required by resistance type electrical water heaters. The small size of an electrode type water heater, due to the absence of the large quantity of stored heated water, makes electrode type water heaters ideally suited for mobile homes or apartments or other applications where space is at a premium.

In an electrode type liquid heater, an electrically conductive liquid is heated by passing an electrical current directly through the liquid between two or more electrodes immersed in the liquid. As is well known, electrical current flows between the electrodes in response to a voltage differential applied across the electrodes.

In the past, various means have been developed to control the flow of current and the liquid heating resulting therefrom. An electrical thermostat in contact with the liquid within the heater may be used as a switch to control the application of the voltage differential to electrodes permanently immersed in the liquid as the temperature of the liquid falls below or rises above preselected temperatures. Alternatively, a voltage differential may be constantly applied across a plurality of electrodes and the flow of electrical current between them controlled by immersing and removing one or more of the electrodes from the liquid. U.S. Pat. No. 3,144,546, of which the present applicant is a co-inventor, discloses an electrode type liquid heater in which a mechanical thermostat immersed within the liquid is linked to a pivoting arm carrying an electrode. As the temperature of the liquid within the heater drops, the thermostat contracts and causes the arm to pivot downwardly, immersing the electrode in the liquid. As the liquid is heated, the thermostat expands and thereby causes the arm to pivot upwardly, lifting the electrode from the liquid. In U.S. Pat. No. 3,809,857, of which the present applicant is inventor, electrodes are mounted on a counterbalanced rotatably buoyant body floating within the liquid heater. A mechanical thermostat, which is mounted to the buoyant body generally opposite the electrodes and immersed in the liquid within the cylinder, extends and retracts an attached movable counterweight. Retraction of the counterweight in response to cooling of the liquid causes the counterweighted side of the body to rotate upwardly, immersing the electrodes on the opposite side of the body. Extension of the counterweight in response to heating of the liquid causes the counterweighted side of the cylinder to rotate downwardly, lifting the electrodes on the opposite side from the liquid. In U.S. Pat. No. 4,326,120, of which the present applicant is inventor, electrodes are mounted to a counterbalanced rotatable buoyant body opposite a fixed counterweight. The electrodes are immersed and withdrawn from the liquid by rotation of the body in response to a bimetallic coiled spring thermostat mounted about the pivot axis of the body and immersed in the liquid within the heater.

Although each of these temperature controlled liquid heaters accomplishes its intended function, all rely upon the mechanical expansion and contraction of non-rigid thermostats or bimetallic springs to provide the immersing force necessary to move the electrodes into the liquid. The liquid heater of the current invention develops that force in a different manner, from the discharge of the liquid flowing into the heater onto a substantially rigid surface of the heating assembly, preferably shaped to form a cup capable of capturing a portion of the flowing liquid.

Accordingly, it is an object of this invention to provide an improved electrode type liquid heater which develops an immersing force from the discharge of liquid flowing into the heater onto a surface connected to movable electrodes in order to control the heating of the liquid by immersing the electrodes.

It is another object of this invention to provide an improved electrode type liquid heater which develops a gravitational immersing force by capturing liquid flowing into the heater in a cup.

It is another object of this invention to provide an improved electrode type liquid heater which develops the immersing force from the impact upon a substantially rigid surface of the liquid flowing into the heater.

SUMMARY OF THE INVENTION

In accordance with the invention, an electrode type liquid heater is provided in which a movable heating assembly carrying an electrode is moved to an immersed position, in which the electrode is immersed in the tank liquid to be heated, in response to the discharge of inlet liquid into the heater from an inlet onto a substantially rigid surface mounted to the heating assembly adjacent the electrode and opposite a counterweight. Preferably, the surface is shaped to form a cup which may capture a sufficient portion of the inlet liquid so that the weight of the captured liquid provides an immersing force to overcome the counterweight and move the heating assembly to an immersed position. The cup is provided with a drain so that it may be emptied when the discharge of inlet liquid into the heater ceases. Additionally, the immersing force may be developed by the impact of moving inlet liquid discharged from the inlet onto the surface. In the absence of the immersing force after the cup has drained and the impact stopped, the counterweight rapidly returns the heating assembly to its normal position with the electrode carried thereby completely removed from the tank liquid so that the heating stops.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
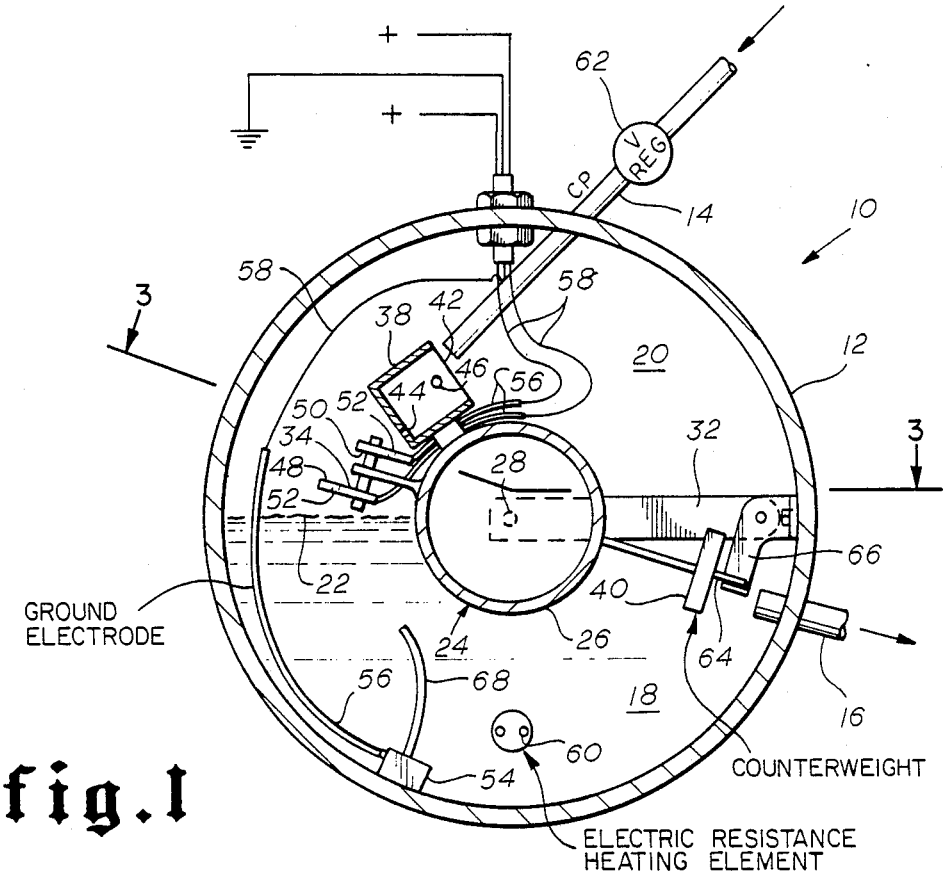
FIG. 1 is a vertical cross sectional view of the liquid heater of the invention in the normal, non-heating position.
Figure 3:
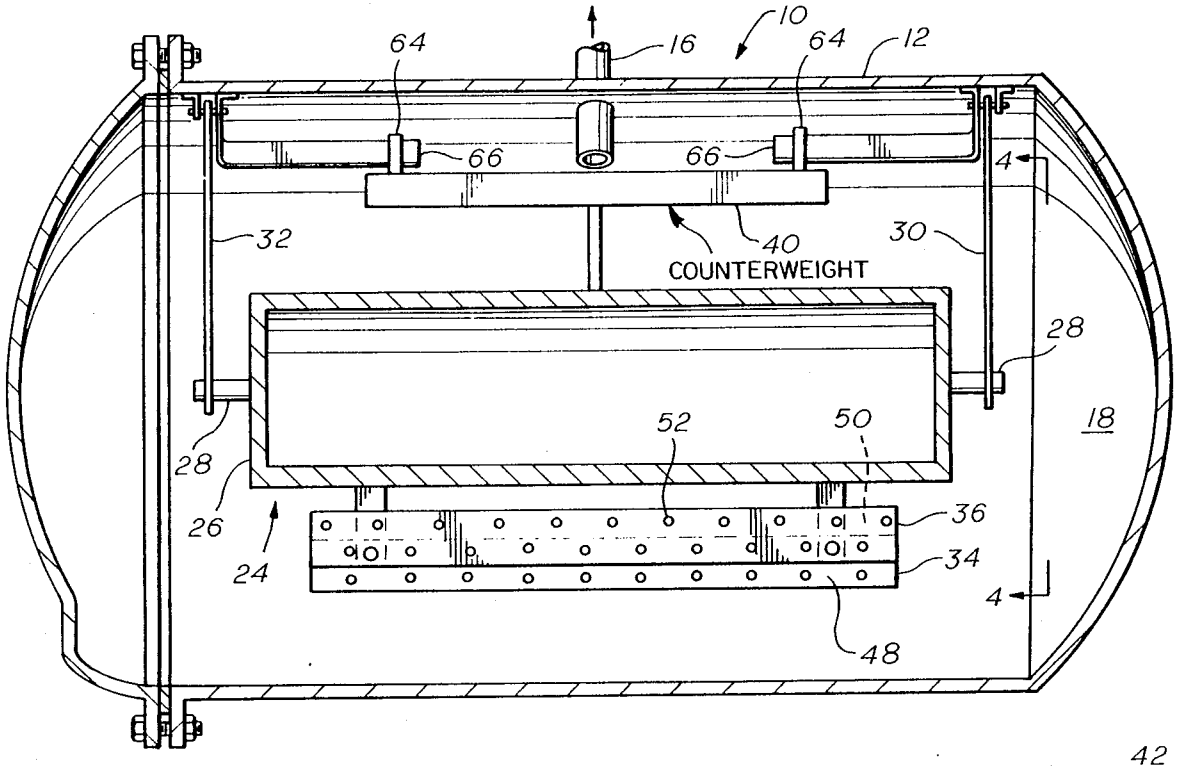
FIG. 3 is a horizontal cross sectional view taken along line 3—3 of FIG. 1 of the liquid heater of the invention.

Turning first to FIGS. 1 and 3, there is shown an electrode type liquid heater 10 which includes a tank 12. In ordinary operation of the liquid heater 10, the tank 12 is partially filled with electrically conductive tank liquid 18 and an airspace 20 filled by a body of electrically non-conductive gas is located above the tank liquid 18. Preferably, the liquid 18 occupies about three-fifths of the volume of the tank 12 and the airspace 20 occupies the remaining two-fifths of the volume. In FIG. 1, the boundary line between the tank liquid 18 and the airspace 20 is shown by a liquid level line 22. Inlet liquid to be heated discharges into the airspace 20 of the tank 12 through an inlet 14, which is preferably located in an upper portion of the tank 12. Heated liquid flows from the tank 12 through an outlet 16, preferably located at least two inches below the liquid level line 22.

The tank 12 may be sealed to the atmosphere outside the tank 12 so that the liquid heater 10 may be used as a part of a pressurized system, not shown, such as a household water distribution system, in which the inlet 14 and the outlet 16 may be connected to household plumbing. At constant pressure in such a system, the volume of gas in the airspace 20 in the liquid heater 10 would remain constant and inlet liquid would be discharged into the tank 12 through the inlet 14 only when tank liquid was caused to flow from the tank 12 through the outlet 16 by the opening of a valve, not shown, downstream in the pressurized system. In order to maintain the liquid heater at a constant pressure, it may be desirable to incorporate a pressure regulating valve 62 in the pressurized system upstream of the inlet 14.

Figure 4:
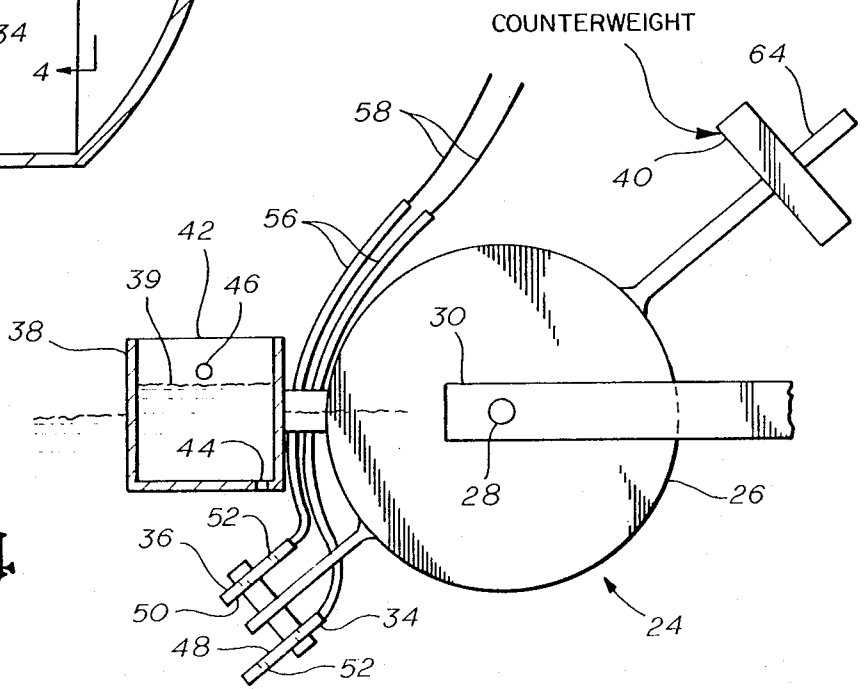
FIG. 4 is a vertical view along line 4—4 of FIG. 3.

The liquid heater 10 is provided with a heating assembly 24 as shown in FIG. 4. The heating assembly 24 preferably includes an elongated floating cylindrical buoyant body 26 rotatable about its axis 28. The axis 28 is in turn connected to a pair of arms 30 and 32 which are themselves pivotally mounted to the tank 12. This pivotal mounting permits the arms 30 and 32 and the floating heating assembly 24 carried thereby to rise and fall with changes in the liquid level 22 within the tank.

At least one and preferably two electrodes 34 and 36 are carried by the body 26 on one side thereof. The heating assembly 24 also includes a surface which is preferably a substantially rigid surface shaped to form a cup 38. The cup 38 is preferably substantially rigidly attached to the body 26 on the same side thereof as the electrodes 34 and 36. The heating assembly 24 includes a counterweight 40 mounted to the body 26 180° opposite from the electrodes 34 and 36. The counterweight 40 is sized so that when the cup 38 is empty and no inlet liquid is being discharged by the inlet 14 onto the cup 38, the counterweight 40 maintains the heating assembly 24 in a non-heating normal position with the electrodes 34 and 36 completely out of the tank liquid 18 and within the non-conductive gas within the airspace 20, as is shown in FIG. 1.

Figure 2:
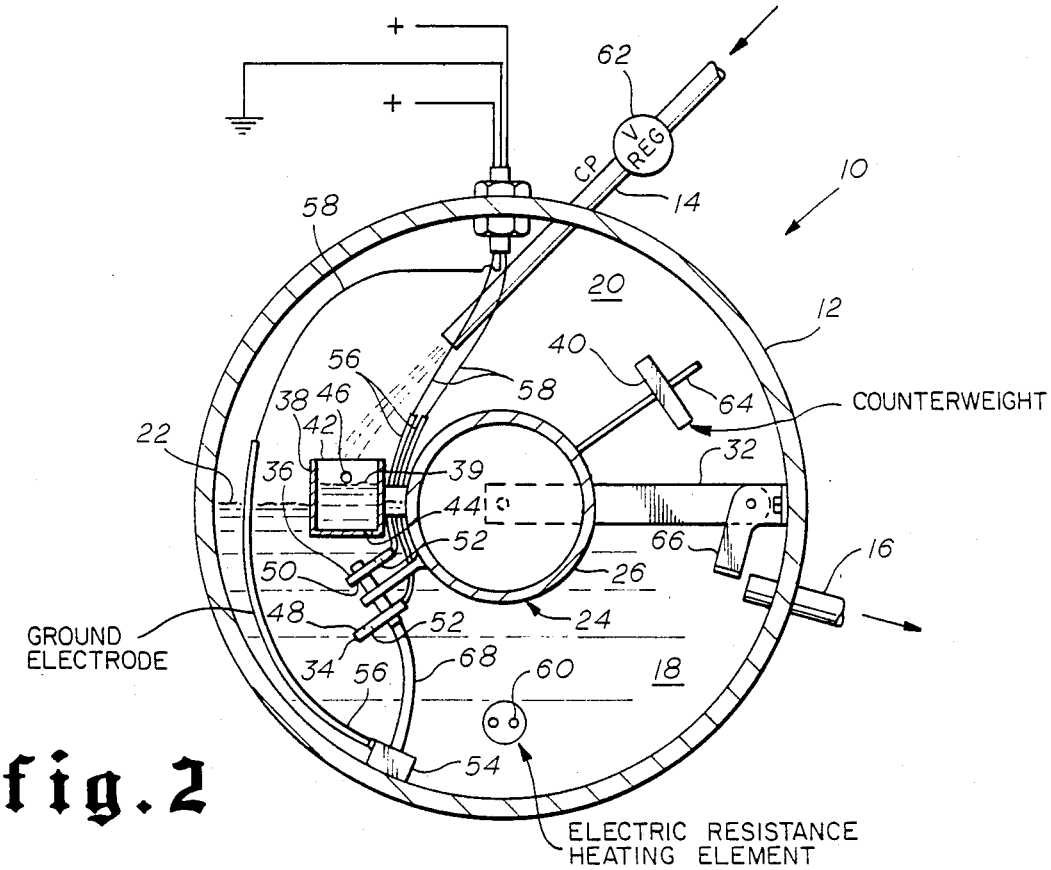
FIG. 2 is a vertical cross sectional view of the liquid heater of the invention in the immersed, heating position.

The heating assembly 24 is rotatable from the normal position shown in FIG. 1 to an immersed position in which the electrodes 34 and 36 carried thereby are at least partially immersed in the tank liquid 18 to be heated, as shown in FIG. 2. A pair of pins 64 mounted to the counterweight 40 engage a pair of stops 66 mounted to the tank 12 to prevent the heating assembly 24 from rotating past the normal position. Similarly, a nonconductive stop rod 68 mounted to the tank 12 engages the electrode 34 to prevent the heating assembly 24 from rotating past the immersed position.

The inlet 14 and the heating assembly 24 are positioned so that the inlet 14 discharges inlet liquid entering the heater 10 onto the cup 38 of the heating assembly 24, which cup 38 is positioned in the airspace 20. An upper opening 42 of the cup 38 is positioned to capture at least a portion of the inlet liquid discharged onto the cup 38. The captured cup liquid is contained within the cup 38.

The cup 38 has a drain 44 in a lower portion thereof. The drain 44 is sized so that cup liquid contained within the cup 38 may drain only at a rate lower than the maximum rate that the upper opening 42 of the cup 38 may capture inlet liquid during ordinary operation of the heater.

When the cup 38 is full, liquid captured by the upper opening 42 at a rate greater than liquid may drain through the drain 44 may overflow the cup through the upper opening 42 or through an overflow opening 46 which may be provided for that purpose. An overflow opening 46 located as shown in FIGS. 1, 2 and 4 has the advantage of maintaining a substantially nonvarying maximum capacity of the cup 38 as the heating assembly 24 rotates.

In the preferred embodiment shown, two flat electrodes 34 and 36 having parallel, spaced apart surfaces 48 and 50 are carried by the heating assembly 24. The spaced apart surfaces 48 and 50 may be laterally offset from each other as shown in FIG. 4 and may be pierced by a multiplicity of holes 52 so as to increase current flow and minimize the buildup of minerals on the electrodes 34 and 36. Although not shown here, apparatus such as that disclosed in my U.S. Pat. No. 4,326,120 may be provided to adjust the gap between the electrodes 34 and 36 from outside the tank 12 to regulate the current flow between the electrodes in response to local water conditions.

Although it can be seen that an electrode type liquid heater requires a minimum of only two electrodes and that only one of such electrodes need be carried by the heating assembly 24, more than two electrodes may be used. Thus the preferred embodiment shown in FIG. 1 has a third ground electrode 54 mounted to the tank 12 below the liquid level line 22. In a conventional three conductor 220 VAC home installation, the two heating assembly electrodes 34 and 36 would be connected to the two opposed phase conductors and the tank mounted electrode 54 would be connected to the neutral conductor. When both of the heating assembly mounted electrodes 34 and 36 are immersed in the tank liquid 18, the electrical current flows directly between them and the third electrode 54 is relatively ineffective. However, as the heating assembly 24 rotates the electrodes 34 and 36 into or out of immersion in the tank liquid 18, a point in the heating assembly's 24 rotation will occur where only the lower electrode 34 is immersed. At that point, a 110 VAC current will flow between the heating assembly mounted electrode 34 and the third electrode 54, heating the liquid at a reduced rate.

The electrodes 34, 36 and 54 are connected to an external electrical power source, not shown, by conductors 56 and 58. For longevity, it is preferred that rigid conductors 56 be used below the liquid level line 22 and that flexible wires 58 be used only above the liquid level line 22 in the airspace 20.

It has been observed that the rate of heating of the tank liquid 18 in an electrode type liquid heater 10 is greater if the tank liquid 18 is initially somewhat warm. For this purpose a thermostatically controlled resistance type liquid heating element 60 may be used to maintain the tank liquid 18 at a minimum preselected temperature such as 110° F. Use of the resistance element 60 permits the more rapid provision of heated liquid after a long period of nonuse of the heater 10, during which the tank liquid 18 within the heater 10 may have cooled as by heat radiation into the atmosphere surrounding the heater 10. The application of exterior insulation, not shown, to the heater 10 will reduce the rate of the heat radiation. The greater liquid heating rate observed when a resistance element 60 is used permits the use of an even smaller liquid heater 10 storing less heated tank liquid 18.

In ordinary operation, a liquid heater 10 of the type disclosed in FIGS. 1 through 4 may be used as a component of a pressurized system such as a single family home water distribution system. Household plumbing, not shown, supplies water under pressure to the inlet 14 and also connects the outlet 16 to one or more downstream valves, not shown, such as those used with sinks or showers, not shown. When all of the downstream valves are shut, the pressure within the household plumbing system and the tank 12 of the liquid heater 10 is substantially constant, no water is flowing and the heating assembly is maintained in its normal position with the electrodes 34 and 36 carried thereby completely out of the tank liquid 18, as shown in FIG. 1.

The opening of a downstream valve causes heated water to flow from the tank 12 through the outlet 16, reducing the pressure within the tank 12. This in turn causes water to flow into the tank 12, being discharged by the inlet 14 into the airspace 20 onto the cup 38. The upper opening 42 of the cup 38 captures at least some part of this inlet water into the cup 38. If the discharge rate of the inlet 14 is above a minimum rate, this capture of inlet water fills the cup 38 more rapidly than it may drain through the drain 44. The weight of the water within the cup 38 becomes a component of the immersing force causing the heating assembly 24 to move from its normal position of FIG. 1 to the immersed position of FIG. 2 in which the electrodes 34 and 36 carried thereby are at least partially immersed in the tank liquid 18 to be heated.

A second component of the immersing force is the impact force of the moving inlet water discharged by the inlet 14 onto the cup 38. The mass of the inlet water discharged by the inlet 14 has a velocity which is changed when the moving water strikes the cup 38, thereby developing another component of the immersing force.

The immersing force causes the heating assembly 24 to move to an immersed position by both rotating and submerging the heating assembly 24. The cup 38 is spaced apart from the axis 28 of the buoyant body 26, so the immersing force developped at the cup 38 creates a turning moment about the axis 28, causing the heating assembly 24 to rotate from the normal position toward the immersed position. The weight component of the immersing force may also increase the submergence of the heating assembly 24 in the tank liquid 18, moving the heating assembly toward the immersed position. A downward component of the impact component of the immersing force may also increase the submergence of the heating assembly 24.

As the heating assembly 24 moves from the normal position to the immersed position, first the electrode 34 and then the electrode 36 are immersed in the tank liquid 18 and finally the cup 38 itself may be partially immersed.

When the electrode 34 first contacts the tank liquid 18, a 110 VAC current flows between the electrode 34 and the third electrode 56, which is permanently immersed in the tank liquid 18. Because of the great distance between the electrodes 34 and 54, the voltage differential of only 110 VAC, and the electrical resistance of the tank liquid 18 between them, which is proportional to the distance, the electrical current is relatively low, heating the tank water 18 at a low rate.

When the second electrode 36 also contacts the tank liquid 18, a 220 VAC differential is applied over the much smaller distance between the two electrodes 34 and 36. Thus a greater electrical current flows at a higher voltage potential, heating the tank water 18 at a more rapid rate. The brief period of time required to completely immerse each electrode reduces the electrical surge which would occur if the heating current began to flow instantaneously.

As the heating assembly 24 partially immerses the cup 38 into the tank liquid 18, a buoyant force acts upwardly on the cup 38. The more deeply the cup 38 is immersed, the greater the buoyant force until an equilibrium is reached and the buoyant force halts the downward motion of the cup 38. Alternatively, the lower electrode 34 may strike the nonconductive stop rod 68 before equilibrium is reached, halting further downward rotation of the heating assembly 24 in the immersed position.

The continuing discharge of inlet water by the inlet 14 while the downstream valve remains open continues to supply inlet water to the cup 38 through the upper opening 42. So long as water is captured by the cup 38 through the upper opening 42 at a greater rate than it drains from the cup 38 through the drain 44, the cup 38 is maintained substantially full of water and the excess water overflows the cup 38 through the overflow opening 46 or the upper opening 42. The weight of the captured water and the impact force continue to provide an immersing force as long as the inlet water flows at a rate above a minimum, thereby maintaining the heating assembly 24 in the immersed position.

When the downstream valve is shut, the discharge of inlet water by the inlet 14 onto the cup 38 ceases. The impact component of the immersing force ceases. Water within the cup 38 continues to drain through the drain 42 because of the higher liquid level 39 within the cup 38. As the cup 38 drains, the weight of the water within the cup 38 is reduced, causing the cup 38 to move upwardly, reducing the buoyant force until the cup 38 is lifted from the water. As the water within the cup 38 continues to drain through the drain 44, the counterweight 40 causes the heating assembly 24 to rotate the electrodes 36 and then 34 out of the water. As electrode 36 first clears the water, the heating current may flow only between the electrodes 34 and 54 at a lower rate as discussed above. When electrode 34 also clears the water, the heating current ceases until one of the downstream valves is again opened, beginning the process all over. The heating assembly 24 returns to its normal position with the pins 64 engaging the stops 66, until a downstream valve is once again opened.

Thus, it is apparent that there has been provided, in accordance with the invention, a flow controlled electrode type liquid heater that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An electrode type liquid heater comprising:

a tank including an inlet and an outlet disposed so that in ordinary operation of the heater said tank is partially filled with electrically conductive tank liquid and there is an airspace filled with a body of electrically nonconductive gas above said tank liquid:

a movable heating assembly within said tank;

a plurality of spaced electrodes within said tank, at least one of which is carried by said heating assembly:

means for applying a voltage differential across said plurality of spaced electrodes;

said movable heating assembly including a surface for developing, in response to discharge of inlet liquid from said inlet onto said surface, an immersing force for causing said movable heating assembly to move from a normal position, in which said at least one electrode carried thereby is out of the tank liquid, to an immersed position, in which said at least one electrode carried thereby is at least partially immersed in the tank liquid;

said movable heating assembly including means for causing said heating assembly to be returned to and maintained in said normal position upon termination of the discharge of the inlet liquid onto said surface; and said surface being positioned at least partially in the airspace and said inlet being positioned to discharge inlet liquid onto said surface.

2. The liquid heater of claim 1 wherein said surface is substantially rigid.

3. The liquid heater of claim 2 wherein said inlet is adapted to discharge inlet liquid onto said surface at a velocity, and wherein the immersing force includes an impact force developed by the impact of the mass of moving inlet liquid on said surface.

4. The liquid heater of claim 2 wherein said surface is shaped to form a cup and said cup is positioned to capture at least a portion of the inlet liquid discharged from said inlet, wherein said cup has a drain sized to empty said cup at a lower rate than a maximum rate at which said cup may capture inlet liquid in ordinary operation of the liquid heater, and wherein the immersing force includes a gravitational force developed by the weight of the inlet liquid within said cup.

5. The liquid heater of claim 4 wherein said movable heating assembly includes a buoyant body floatable in the tank liquid so that said body is partially submerged in the tank liquid when said movable heating assembly is in the normal position during ordinary operation of the heater;

wherein said cup is substantially rigidly connected to said buoyant body; and wherein the immersing force causes said movable heating assembly to move from the normal position toward the immersed position by further submerging said buoyant body.

6. The liquid heater of claim 4 wherein said movable heating assembly is rotatable between the normal position and the immersed position, and wherein the immersing force develops a turning moment about an axis of rotation of said movable heating assembly.

7. The liquid heater of claim 6 wherein said movable heating assembly includes a buoyant body floatable in the tank liquid so that said buoyant body is partially submerged in the tank liquid during ordinary operation of the liquid heater.

8. The liquid heater of claim 7 wherein said cup is at least partially immersed in the tank liquid when said movable heating assembly is in the immersed position so that a buoyant force acts upwardly on said cup in opposition to the immersing force.

9. The liquid heater of claim 7 wherein said cup has an overflow opening in an upper part thereof.

10. The liquid heater of claim 7, further comprising:

an electrical resistance heating element at least partially immersed in the tank liquid.

11. An electrode type water heater comprising:

a tank including an inlet and an outlet disposed so that in ordinary operation of the heater, said tank is partially filled with tank water and there is an airspace filled with a body of electrically nonconductive air above said tank water;

a buoyant body rotatable about an axis;

at least two spaced electrodes mounted to the buoyant body on a first side thereof;

means for applying a voltage differential across said electrodes;

a cup mounted to the buoyant body on the first side thereof;

a counterweight mounted to the buoyant body on a second side thereof opposite the first side so that when said cup is empty, the counterweight rotates said body so that said electrodes are completely out of the tank water, and so that when said cup is full of water, the weight of the water within said cup overcomes the weight of said counterweight and rotates said body so that said electrodes are at least partially immersed in the tank water; and said cup having an upper opening positioned to capture at least a portion of the inlet water discharged into said tank by said inlet and further having a drain in a lower portion thereof sized to empty said cup at a lower rate than a maximum rate at which said cup may capture inlet water in ordinary operation of the heater.

* * * * *